US010968068B1

(12) United States Patent
Herrmann et al.

(10) Patent No.: US 10,968,068 B1
(45) Date of Patent: Apr. 6, 2021

(54) RETAIL EDGE MARKER ACCUMULATION AND COLLATION SYSTEM

(71) Applicant: XEROX CORPORATION, Norwalk, CT (US)

(72) Inventors: Douglas K Herrmann, Webster, NY (US); Gregory A Ludgate, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/727,279

(22) Filed: Dec. 26, 2019

(51) Int. Cl.

| | |
|---|---|
| ***B65H 39/04*** | (2006.01) |
| ***B65H 39/043*** | (2006.01) |
| ***B65H 31/30*** | (2006.01) |
| *B65H 39/055* | (2006.01) |
| *B65H 31/24* | (2006.01) |

(52) U.S. Cl.
CPC ..... *B65H 39/043* (2013.01); *B65H 31/3081* (2013.01); *B65H 31/24* (2013.01); *B65H 39/055* (2013.01); *B65H 2301/4213* (2013.01); *B65H 2301/42122* (2013.01); *B65H 2301/4352* (2013.01)

(58) Field of Classification Search
CPC .. B65H 31/24; B65H 31/3081; B65H 39/043; B65H 39/055; B65H 2301/42122; B65H 2301/4213; B65H 2301/4352
USPC ..... 270/52.16, 58.26, 58.29
See application file for complete search history.

(56) References Cited

U.S. PATENT DOCUMENTS

| | | | | |
|---|---|---|---|---|
| 1,861,406 | A * | 5/1932 | Cook | B65H 39/075 270/58.26 |
| 4,511,132 | A * | 4/1985 | Muller | B65H 3/446 270/58.29 |
| 7,665,720 | B2 * | 2/2010 | Mori | B65H 39/115 270/52.16 |
| 9,463,945 | B2 | 10/2016 | Herrmann | |
| 9,463,946 | B2 | 10/2016 | Herrmann | |
| 9,527,693 | B2 | 12/2016 | Herrmann | |
| 9,624,062 | B1 * | 4/2017 | Herrmann | B65H 31/3081 |
| 10,071,877 | B2 * | 9/2018 | Herrmann | B65H 39/043 |
| 2016/0200544 | A1 * | 7/2016 | Herrmann | B65H 39/043 270/58.26 |

* cited by examiner

*Primary Examiner* — Leslie A Nicholson, III

(57) ABSTRACT

A system for collating and stacking long cut retail edge marker strips exiting a roll fed high speed slitter/perforator/cutter apparatus includes a series of angled and stepped baffles configured to receive the cut retail edge marking strips and allow them to fall into and accumulate in bins formed by each angled baffle and then be removed from each bin consecutively by a pusher acting orthogonally to the bins to move and collate the retail edge markers into a final stack collated to meet a specific store planogram requirement.

21 Claims, 9 Drawing Sheets

RETAIL EDGE MARKER ACCUMULATION AND COLLATION SYSTEM

BACKGROUND

The presently disclosed embodiment is directed to providing a collation system, and more particularly, to a collation system that employs unique angled collation baffles for loading and unloading retail edge marker strips destined for in-store shelves.

Retail stores often utilize edge markers to convey information regarding products offered for sale, e.g., product costs, unit cost, sale pricing, etc. Such markers must be updated and/or replaced on a periodic basis. For example, regular product pricing may change, or during a sale, a discounted price may be necessary. Changes to edge markers may be required for hundreds or even thousands of products and these changes may be required daily weekly or another periodic term. In addition, product placement may change which would require updating of the edge markers. In some states, it is critical that the edge markers be updated in a timely fashion as the retail store may be obligated to honor the price displayed adjacent the product. In other words, if the store fails to remove the edge marker that displays a discounted cost, the store must charge that cost if a customer relies upon that price when making a purchase selection. In view of the foregoing, it should be apparent that proper timing and placement of edge markers is a critical responsibility of a retail store.

Although some retail chain stores share common store layouts, also known as a store planogram, most retail locations, even within a chain store have unique store planograms. The changeover of store signage can incur significant time which in turn incurs significant cost. A common practice is to print sheets of edge marker strips and an employee or group of employees are tasked with edge marker changeover. These methods include various deficiencies, e.g. edge marker strips compiled out of order or not matched to the store planogram, sheets that require further separation of individual store departments, etc. These method are quite costly and presently, in at least one instance, requires for example, 20 people employed to individually catch and collate each sheet of edge markers. Other media collating systems including U.S. Pat. Nos. 9,463,945 B2, 9,463,946 B2 and 9,527,693 B2, are known, but the heretofore-mentioned problems persist.

Obviously, there is a need for a more efficient shelf edge marker collation system that presents shelf edge markers to store employees in a per store planogram order for in-store deployment.

SUMMARY

Accordingly, in answer to this need, disclosed herein is a system for accepting edge marker strips from a slitting apparatus into angled baffles where they are accumulated as they exit the slitting apparatus. The angled baffles allow the edge marker strips to fall into place in bins during the accumulation stage and then be collated from the bins into a final stage after all of the edge marker strips have been fed from the slitting apparatus. At the end of the accumulation stage, a pusher device is moved orthogonally to the edge marker strips to remove the edge marker strips from the bins and thereby collate the edge marker strips for shipment. The edge marker strip piles are ordered and separated per store by the system to allow efficient deployment in-store.

BRIEF DESCRIPTION OF THE DRAWINGS

Various of the above-mentioned and further features and advantages will be apparent to those skilled in the art from the specific article or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
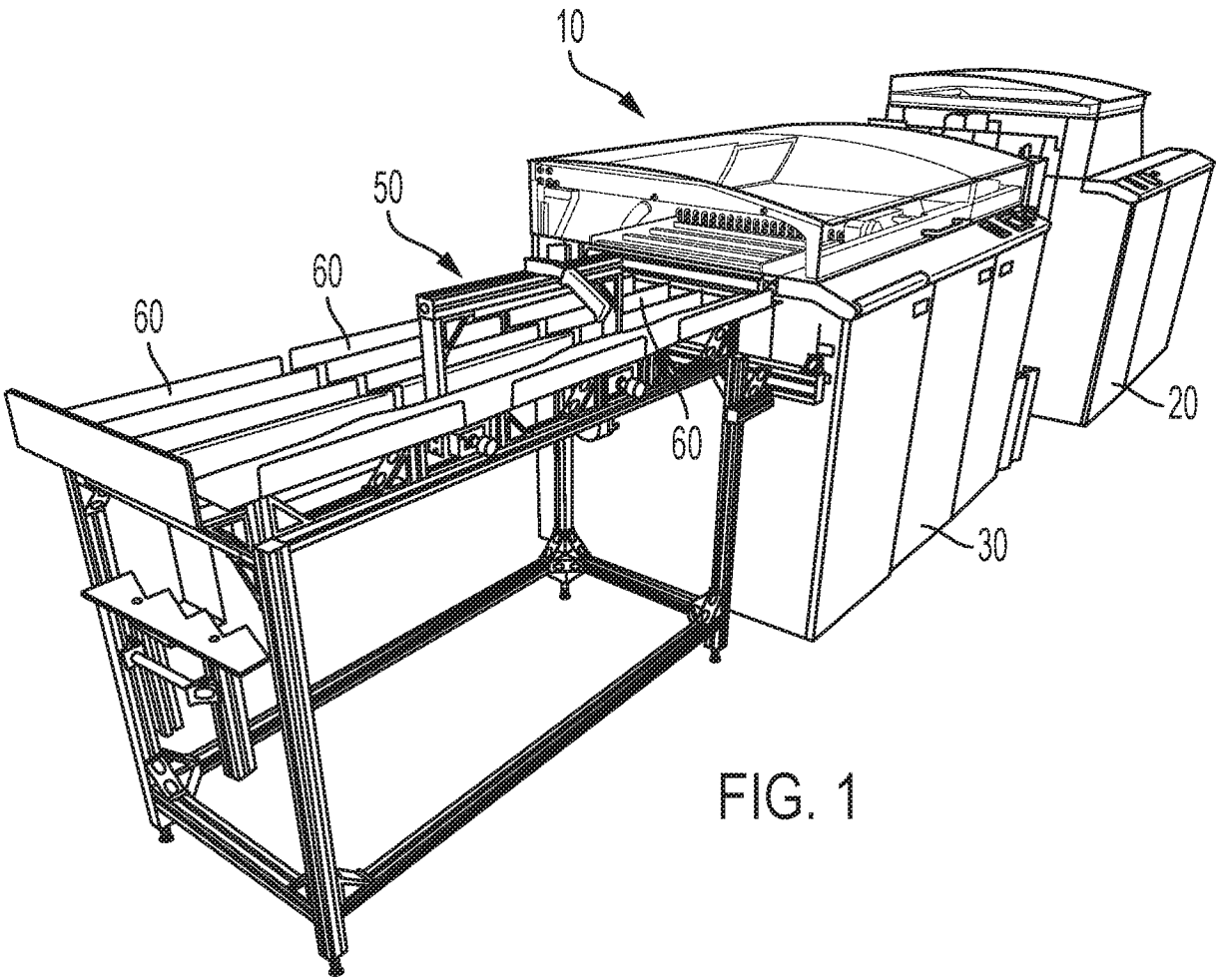
FIG. 1 is partial perspective view of a collator in accordance with the present disclosure connected to slitter and unwinder off-line processing system.

For a general understanding of the features of the disclosure, reference is made to the drawings. In the drawings, like reference numerals have been used throughout to identify identical elements.

Referring now to FIG. 1, there is shown a system 10 for outputting printed shelf edge markers from a conventional unwinder 20 that roll feeds edge markers in continuous sheet form into a conventional perforator/slitter/cutter 30 that slits and cuts the continuous roll fed sheet of shelf retail edge markers into extended predetermined lengths of, e.g., 4 feet to 5 feet. Each predetermined sheet length is slit into four separate and individual strips and each individual strip is perforated into four different parallel sections to accommodate different in-store requirements. While this system feeds roll stock and cuts and perforates the stock, it does not include a system for accumulating and collating in-store shelf edge strips exiting the system.

Figure 2:
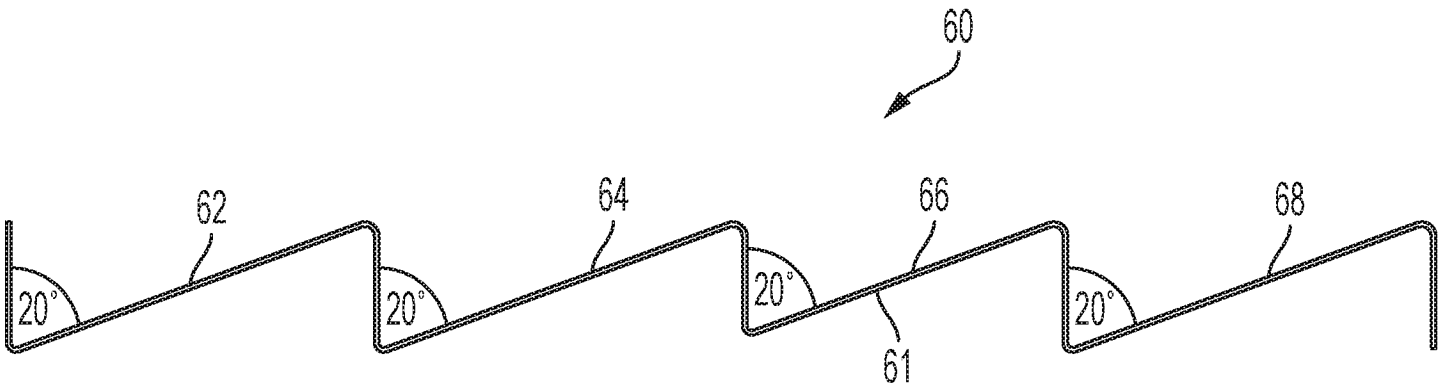
FIG. 2 is a side view of a baffle accordance with the present disclosure and used in the collator in FIG. 1.
Figure 4:
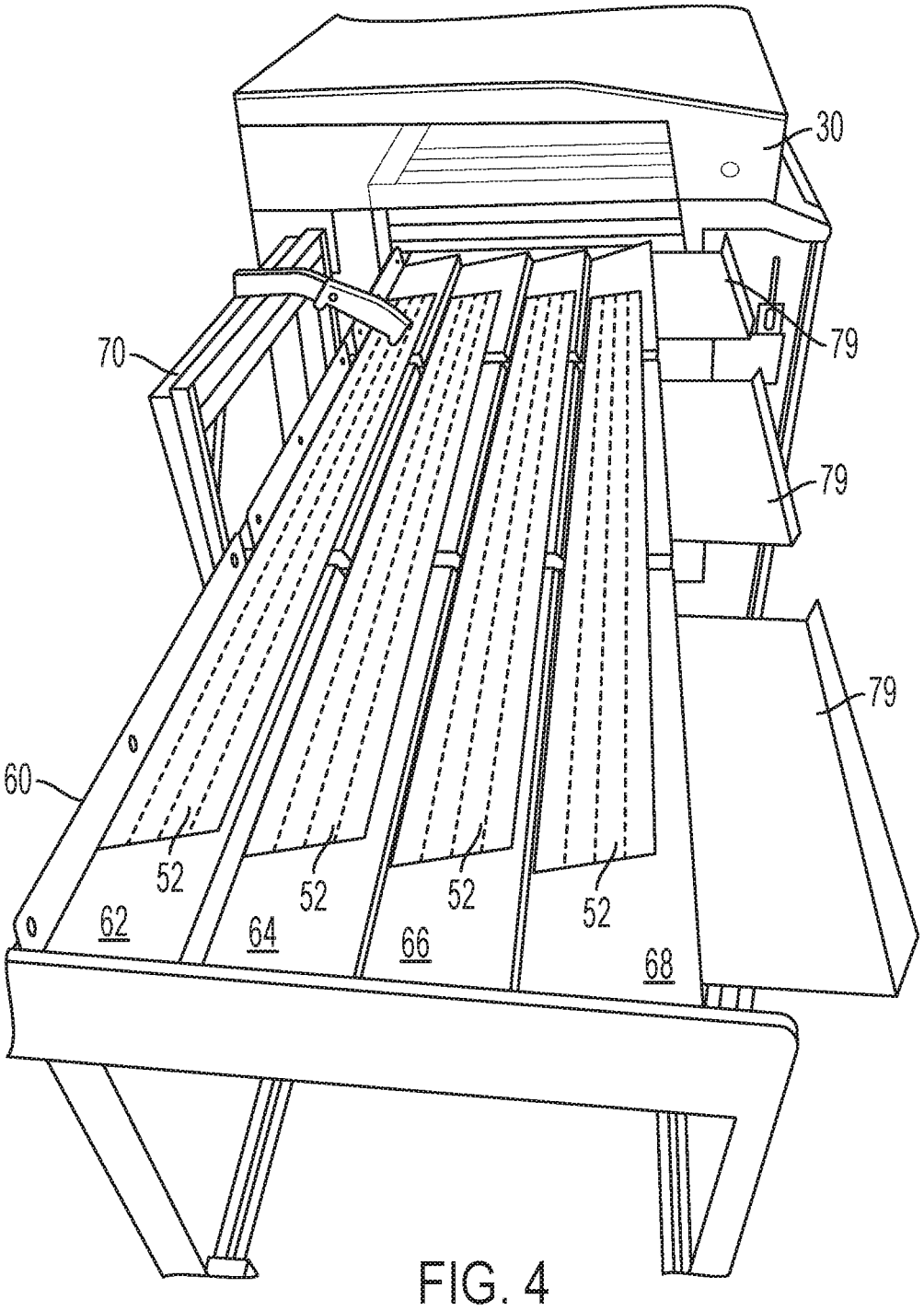
FIG. 4 is a partial end view of the collator of FIG. 1 showing slit edge marker strips resting therein.

In accordance with the present disclosure, an accumulation and collation system 50 is disclosed in FIG. 1 that fits directly after the perforator/slitter/cutter 30 of the continuous roll feed system 10 that converts the edge markers roll into perforated and cut strips 52 shown in FIG. 4 and includes a series of angled baffles 60 that are identical and include bins 62, 64, 66 and 68 more clearly shown in FIG. 2 that accept and register the retail edge marker strips 52 from the perforator/slitter/cutter 30 and accumulates them as they exit perforator/slitter/cutter 30. Each angled baffle 60 is configured to allow retail edge marker strips exiting perforator/slitter/cutter 30 to cascade from the upstream angled baffle eliminating stub points and provides a downward slope to help the retail edge marker strips to be conveyed down the baffles. Bins 62, 64, 66 and 68 of angled baffles 60 are configured to allow the retail edge marker strips 52 to fall into place during the accumulation stage and then allow the retail edger marker strips 52 to be collated onto a final stack platform 79 after all of the retail edge marker strips 52 have been fed from perforator/slitter/cutter 30. At the end of the accumulation stage, a pusher 70 is moved orthogonally to the retail edge marker strips 52 to remove the retail edge marker strips from each bin onto the top of retail edge marker strips in bins of baffles 60 in succession to collate the retail edge marker strips onto final stack platform 79.

An exemplary angled baffle 60 is shown in FIG. 2 that includes bin shelves equal in width with the exception of bin shelf 61 which is shorter or narrower. The shelves of bins 62, 64, 66 and 68 are critically positioned at an angle of approximately 20° in order to facilitate having the retail edge marker strips 52 separate and accumulate in the bins automatically by letting the retail edge markers strips drop and slide to the bottom of the bins. The bins edges also register longer retail edge marker strips. The narrower shelf 61 is critical in that it is necessary to accommodate different retail edge marker strip widths with the same angled shelve. When starting from the center line of the sheet of retail edge markers this keeps the different width retail edge marker strips in the last bin from overlapping the third bin which would then allow the edge of the last set of retail edge marker strips to get hung up on the tip of the angled shelf when they are being fed in from the upstream perforator/slitter/cutter 30.

Figure 3:
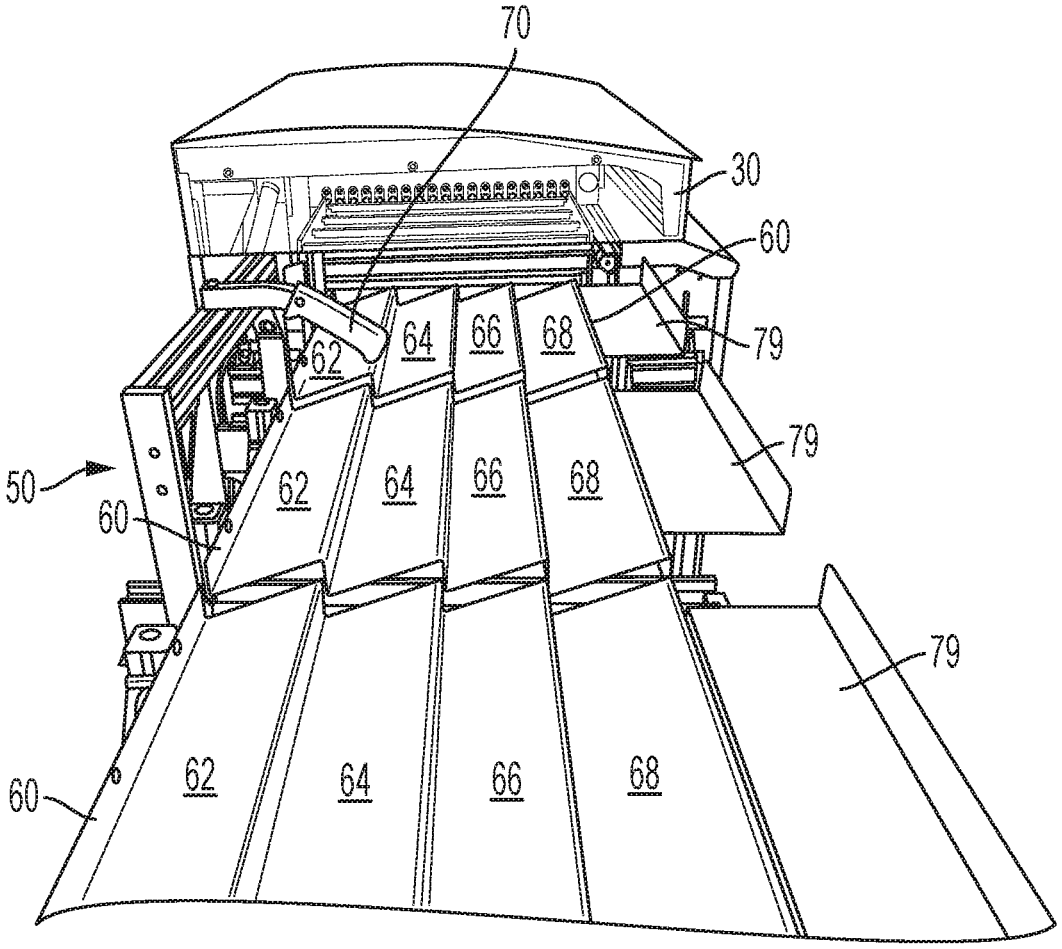
FIG. 3 is a partial end view of the collator of FIG. 1 showing a series of angled baffles.

As shown in FIG. 3, each bin 64, 66 and 68 is stepped downward an increment, as well as staggered backward after bin 62 in order to prevent stubbing of retail edge marker strips on edges of a succeeding bin. In addition, the stepping and staggering of each bin with respect to the preceding one enhances registering long retail edge marker strips exiting perforator/slitter/cutter 30. Pusher 70 is arranged for pulling through openings between bins 60 towards platform 79 to unload retail edge marker strips from each bin and simultaneously convey the retail edge marker strips onto platform 79 into a collated stack. By doing the final collation in the cross process direction, it allows the operator, or system if automated, to collect the bin stacks of retail edge marker strips at the edge in the short move direction allowing for a fast collation process and reduces delay in the high speed continuous feed system which can stop and buffer for five seconds. Collating in the orthogonal direction from the feed direction, facilitates collation in that five second interval. Alternatively, while a five second buffer stop is preferred, the buffer could be more or less than five seconds and could stop until an operator action is performed rather than for a set time. Preferably, an optical mark is included on the edge trim of the last retail edge marker strip that is that is sensed to signal the system to stop and wait for the orthogonal pusher operation. The depth of the bins allow retail edge markers for an entire store to be accumulated prior to collating into a stack. The retail edge strip markers can also be accumulated and then pushed at predetermined break points if a store volume is too large of if the process can be improved by using set breakpoints.

Figure 5:
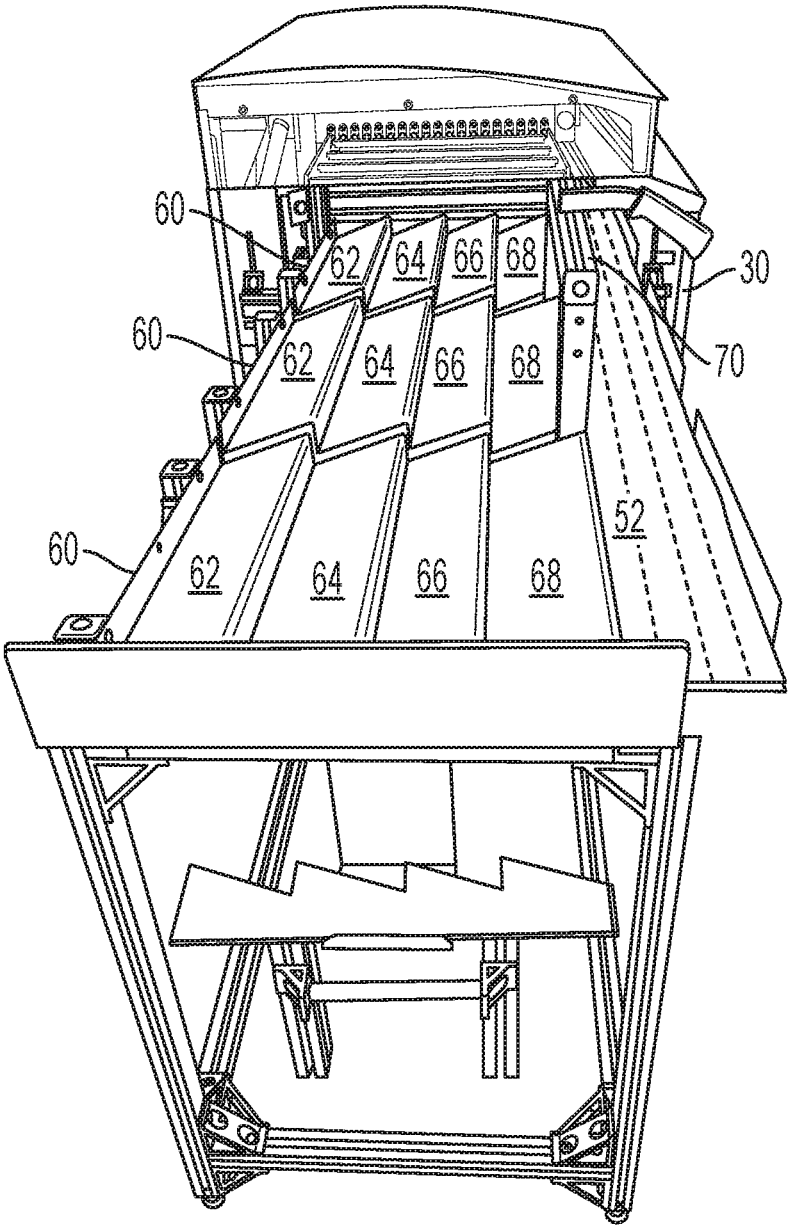
FIG. 5 is partial end view showing a final bundle of collated the edge marker strips shown in FIG. 4.

Bundles of retail edge marker strips 52 in FIG. 4 are shown in baffles 60 after exiting perforator/slitter/cutter 30 and settling into bins 62, 64, 66 and 68 ready for a single collation push onto compiling platform 79. Each bundle of retail edge marker strips 52 is made up of four retail edge marker strips separated by a perforation for ease in separating the retail edge marker strips for placement onto store shelf edges. In FIG. 5, a final collated bundle is formed by moving pusher 70 in a cross process direction across the angled baffles to stack the separate bundles into a single bundle and in in-store planogram order.

Figure 6:
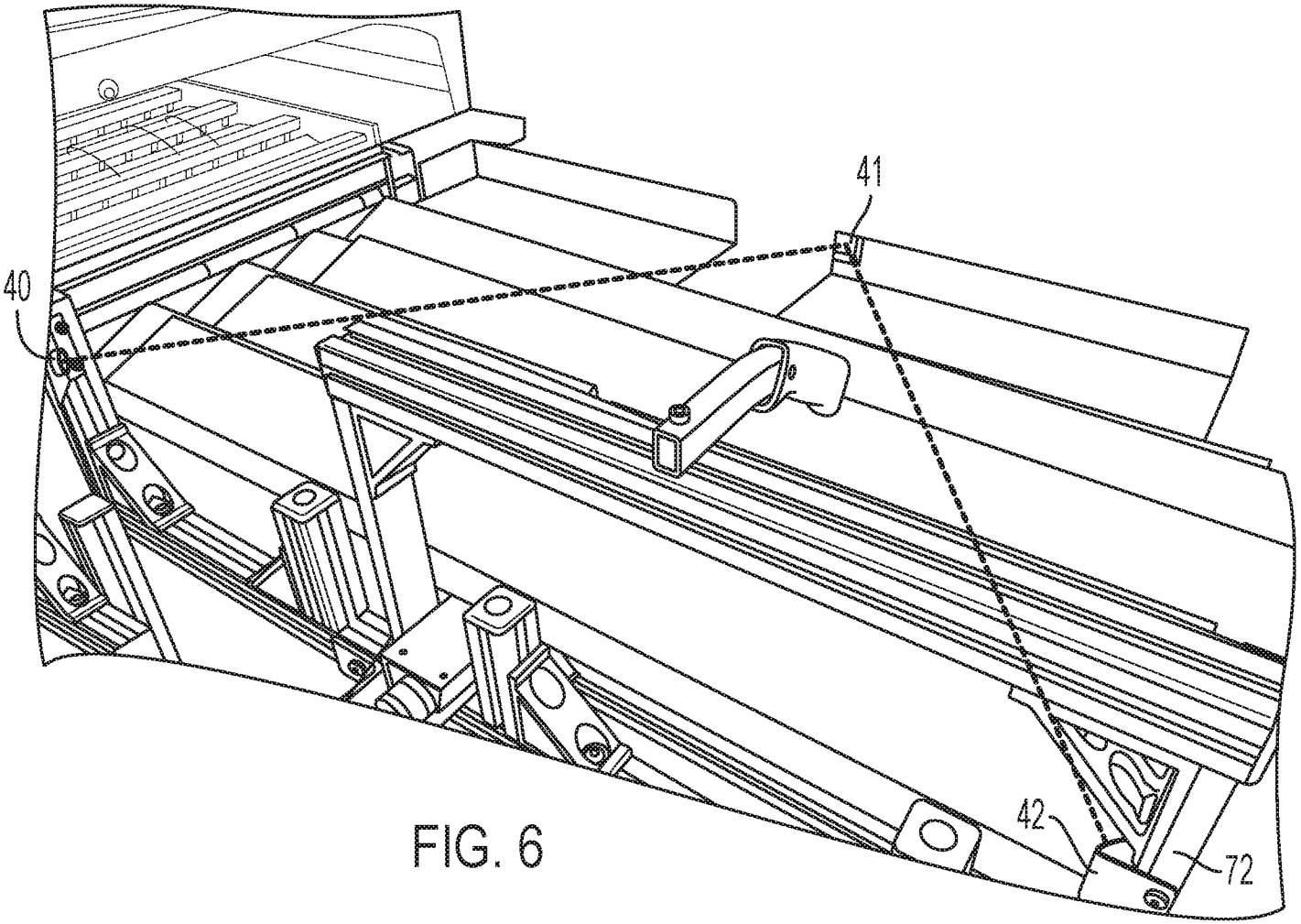
FIG. 6 is a perspective view of a jam detecting sensing system in accordance with the present disclosure.

A sensing arrangement is shown in FIG. 6 that shuts the system down if there is a jam or pileup of retail edge markers in baffles 60 and includes a dual use retro-reflective sensor 40 (Banner QS18) that directs a beam into mirror 41 mounted on a wall portion connected to compiling platform 79. The beam reflects off mirror 41 and against a reflector 42 that is mounted on upstanding support member 72 shown in FIG. 1 which assists in supporting pusher 70. The beam is then reflected back from reflector 42 to retro-reflective sensor 40. If for any reason the beam is broken, e.g., a jam or misaligned retail edge marker strips, the system 10 will be stopped. Dual use retro-reflective sensor 40 is also used to ensure that pusher 70 is back in the home position before giving a stacker ready signal.

Figure 7:
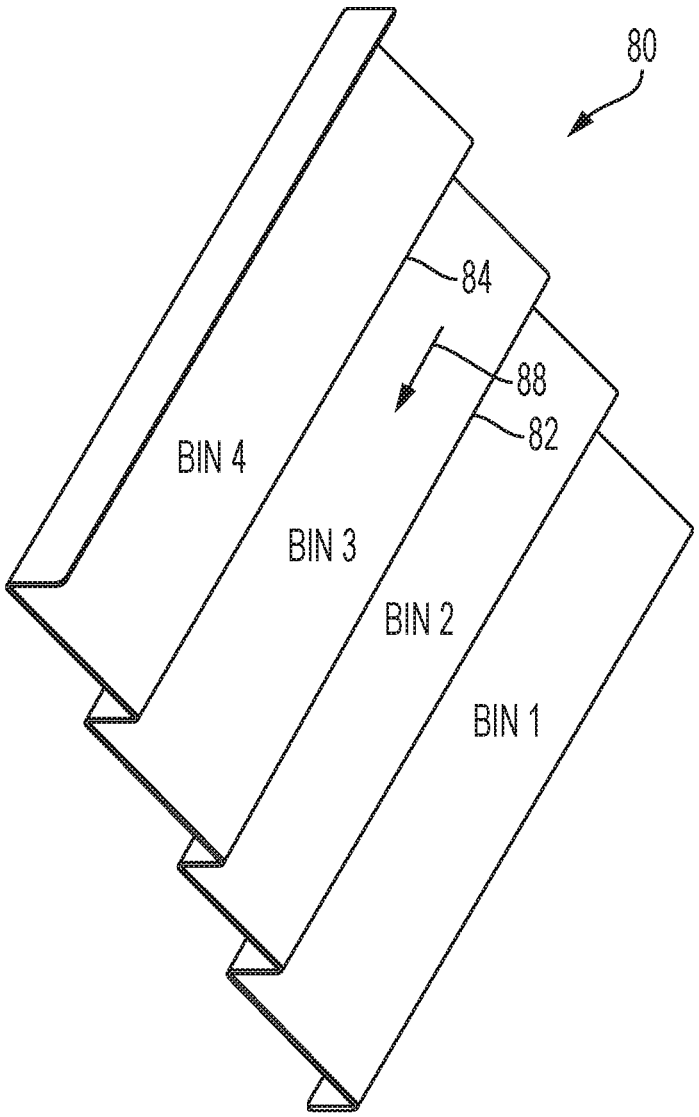
FIG. 7 is perspective view of an alternative embodiment in accordance with the present disclosure that shows a baffle with a kicker bin.
Figure 8:
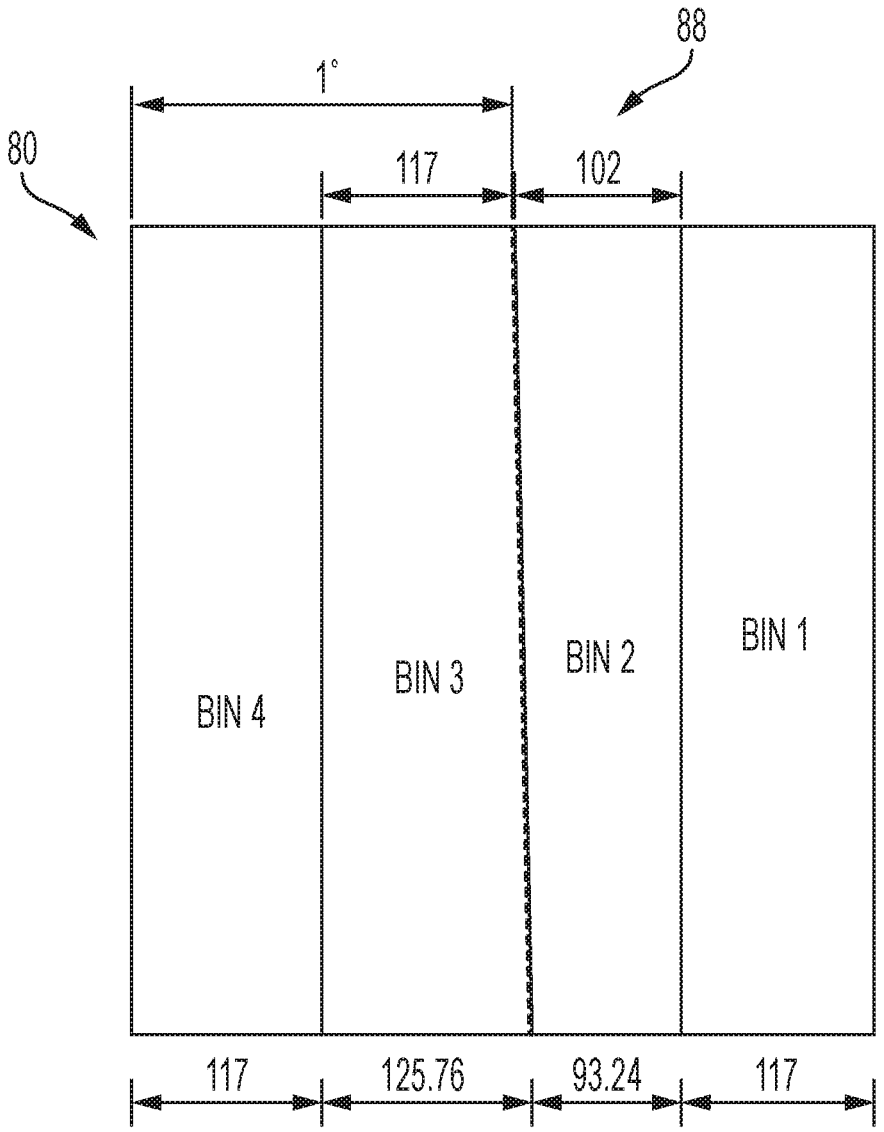
FIG. 8 is schematic top view of the baffle with a kicker bin shown in FIG. 7.

Another embodiment of the collator in accordance with the present disclosure is shown in FIGS. 7 and 8 and includes a baffle 80 that is positioned furthest from perforator/slitter 30 and accepts incoming retail edge marker strips conveyed in the direction of arrow 88. Baffle 80 includes a kicker bin 2 that that is the narrowest of the bins 1 through 4 and has an upstanding back portion that is tilted at an angle of 1° with respect to an upstanding portion of bin 3 of about 1° to bump the lead edge of incoming retail edge marker strips. This bump is critical in that it assists in separating the trail edge of a bumped retail edge marker strip from a retail edge marker strip entering bin 1.

Figure 9:
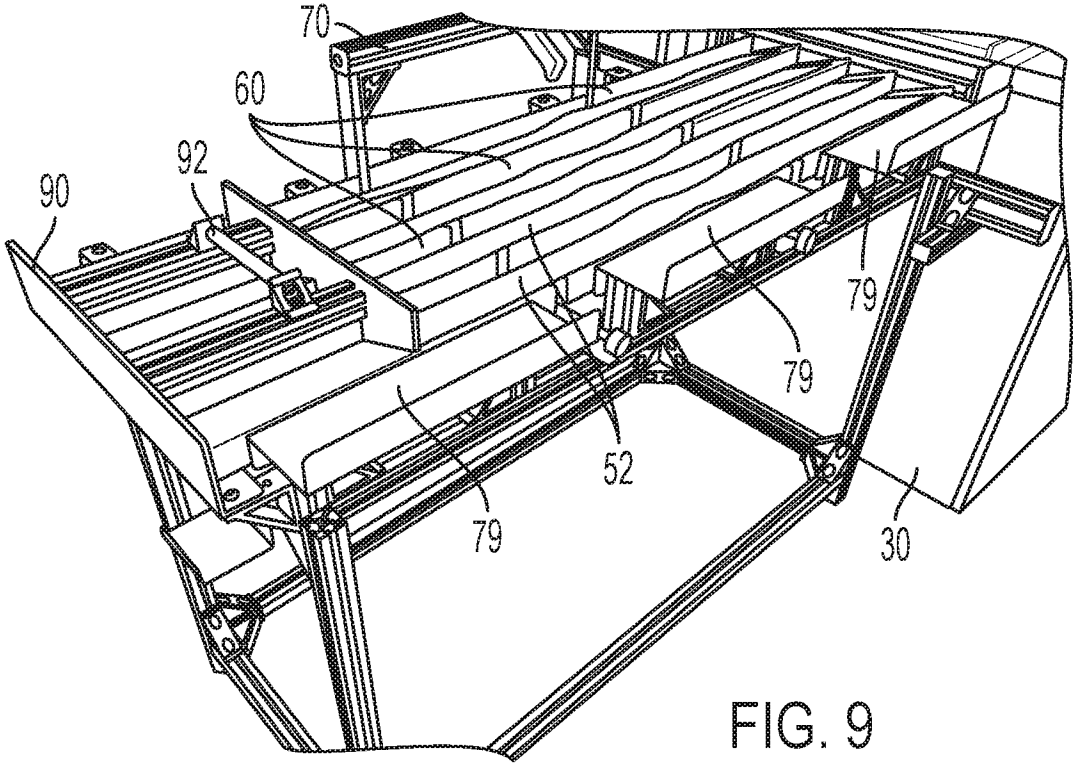
FIG. 9 is perspective view showing a stopper that allows the baffles of FIG. 1 to accommodate edger marker strips of a different length.

In FIG. 9, a stopper 90 is shown that is inserted using handle 92 into a portion of the baffle 60 farthest downstream from perforator/slitter 30 to change the length of retail edge marker strips 52. This facilitates system 10 outputting both 4 and 5 feet lengths of retail edge strip markers.

It should be understood that an accumulation and collation system has been disclosed that collates retail edge markers which have been cut from a high speed continuous feed roll and fall directly into bins of a plurality of one or single piece stepped and angled baffles that drop downward and back from each other consecutively to provide both separation and registration of long media strips. The stepped and angled baffles are configured to allow the cut media to slide successively from the first of the plurality of stepped and angled baffles to the last angled baffle to eliminate stubbing points and provide a downward slope to ease the conveying of the media strips down the angled baffles. After all of the retail edge markers have settled into respective baffle bins a cross process collation system is actuated that includes a pusher that is used to orthogonally contact the retail edge markers and empty the first bin contents on top of the contents of the next bin and continue consecutively until all of the retail edge markers are pushed as one bundle onto a compiling or final collation platform for pick-up and distribution to a specific store identified on the edge markers. Cross process collation of the retail edge markers is performed after each store or job requirement is completed and the cross process collation is critical in that it facilitates compiling of the retail edge markers on the final collation platform in the shortest distance for reduced delay in feeding the retail edge markers to the accumulation and collation system.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A collator for accumulating and collating media strips exiting an upstream source, comprising:

a series of angled baffles with each of said series of angled baffles configured to include bins that receive said media strips longitudinally with each of said media strips extending over at least two of said series of angled baffles;

wherein said series of baffles includes an upstream angled baffle with each of the remainder of said series of baffles configured to cascade from said upstream baffle to eliminate media strip stub points while simultaneously providing a downward slope to enhance media strips sliding down said series of baffles; and a pusher configured for movement in a cross process direction to said media strips after said media strips have settled into said bins to pull said media strips in collated form from said bins and into a compiled collated stack in store planogram order.

2. The collator of claim 1, wherein said series of angled baffles are staggered with respect to each other in a direction cross-wise with respect to incoming media strips.

3. The collator of claim 1, wherein said series of angled baffles are stepped one below another from said upstream angled baffle to the last of said series of baffles.

4. The collator of claim 2, wherein said series of angled baffles slope downward from an exit of said source.

5. The collator of claim 3, wherein said series of angled baffles slope downward from an exit of said source.

6. The collator of claim 5, wherein said series of angled baffles includes at least four baffles.

7. The collator of claim 1, including a removable stopper that facilitates said collator accommodating media strips of multiple lengths.

8. The collator of claim 1, wherein each of said series of angled baffles after the first one is stepped downward with respect to the previous one.

9. The collator of claim 1, wherein each said series of angled baffles after the first one is staggered backward after said first baffle in order to prevent stubbing of media strips on edges of a succeeding baffle.

10. A method for accumulating and collating media strips exiting an upstream source, comprising:

providing a plurality of angled baffles with each of said plurality of angled baffles configured to include bins that receive said media strips with each of said media strips extending over at least two of said plurality of angled baffles;

feeding said media strips onto a longitudinal surface of said bins from said upstream source;

wherein said series of baffles includes an upstream angled baffle with each of the remainder of said plurality of baffles configured to cascade from said upstream baffle to eliminate media strip stub points while simultaneously providing a downward slope to enhance media strip sliding down said plurality of baffles; and providing a pusher configured for movement orthogonally to said bins after said media strips have settled into said bins to pull said media strips in collated form from said bins and into a compiled collated stack in store planogram order.

11. The method of claim 10, including staggering each of said plurality of angled baffles one behind another after the initial one.

12. The method of claim 10, including stepping said plurality of angled baffles one below another from said upstream angled baffle to the last of said plurality of angled baffles.

13. The method of claim 10, including providing a bin within a baffle of said plurality of angled baffles positioned farthest from said source angled at about 1° with respect to an adjacent bin.

14. The method of claim 12, including sloping said plurality of angled baffles downward from an exit of said source.

15. The method of claim 10, wherein said plurality of angled baffles includes at least four baffles.

16. The method of claim 10, wherein each of said bins include a shelf angled at about 20 degrees to assist in tipping of each media strip on edge.

17. The method of claim 10, wherein each of said series of angled baffles after the first one is is downwardly staggered with respect to each previous one in order to prevent stubbing of said media strips on edges of a succeeding baffle.

18. The method of claim 17, wherein each said series of angled baffles after the first one is offset backward of each other after the first of said angled baffles.

19. An arrangement for collating media strips exiting an upstream source, comprising:

multiple angled baffles with each of said multiple angled baffles configured to include multiple bins that receive said media strips longitudinally of said bins;

wherein said multiple angled baffles are stepped and staggered with respect to each other to eliminate media strip stub points while simultaneously providing a downward slope to enhance sliding of said media strips down said multiple angled baffles; and a pusher configured for movement orthogonally to said longitudinal surfaces of said multiple angled bins after settling of said media strips into said multiple angled bins to remove said media strips in collated form from said multiple angled bins and into a compiled collated stack in store planogram order.

20. The arrangement of claim 19, wherein one of said multiple angled baffles includes a bin with an upstanding wall portion thereof that is angled with respect to an upstanding wall of a bin on one side thereof in order to bump a leading edge of an incoming media strip to thereby assist in separating a trail edge of said incoming media strip from a media strip entering a bin on another side of said bin.

21. The arrangement of claim 19, wherein one of said multiple angled baffles includes bin shelves equal in width and one bin shelf that is less than said equal width to accommodate different retail edge marker strip widths.

* * * * *